US008371201B2

(12) United States Patent
Deflumere et al.

(10) Patent No.: US 8,371,201 B2
(45) Date of Patent: Feb. 12, 2013

(54) METHOD AND APPARATUS FOR EFFICIENTLY TARGETING MULTIPLE RE-ENTRY VEHICLES WITH MULTIPLE KILL VEHICLES

(75) Inventors: Michael E. Deflumere, Winchester, MA (US); Richard J. Venuti, Greenville, NH (US); Fernando M. Faria, Westford, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 852 days.

(21) Appl. No.: 11/579,367

(22) PCT Filed: Aug. 18, 2005

(86) PCT No.: PCT/US2005/029485

§ 371 (c)(1),
(2), (4) Date: Aug. 18, 2008

(87) PCT Pub. No.: WO2007/015698

PCT Pub. Date: Feb. 8, 2007

(65) Prior Publication Data

US 2009/0000465 A1 Jan. 1, 2009

Related U.S. Application Data

(60) Provisional application No. 60/604,314, filed on Aug. 25, 2004.

(51) Int. Cl.
*F42B 15/01* (2006.01)

(52) U.S. Cl. ..... 89/1.11

(58) Field of Classification Search ..... 89/1.11
See application file for complete search history.

(56) References Cited

U.S. PATENT DOCUMENTS

| | | | | | |
|---|---|---|---|---|---|
| 3,848,830 | A * | 11/1974 | Born | 244/3.16 |
| 4,349,838 | A * | 9/1982 | Daniel | 348/169 |
| 4,638,737 | A * | 1/1987 | McIngvale | 102/489 |
| 5,042,743 | A * | 8/1991 | Carney | 244/3.11 |
| 5,062,586 | A * | 11/1991 | Hobson et al. | 244/3.12 |
| 5,273,236 | A * | 12/1993 | Wootton et al. | 244/3.11 |
| 5,350,134 | A * | 9/1994 | Crawford | 244/3.16 |
| 5,501,413 | A * | 3/1996 | Kilger et al. | 244/3.15 |
| 5,775,636 | A * | 7/1998 | Vig et al. | 244/3.24 |
| 6,741,341 | B2 * | 5/2004 | DeFlumere | 356/141.1 |
| 6,877,691 | B2 * | 4/2005 | DeFlumere et al. | 244/3.16 |
| 7,032,858 | B2 * | 4/2006 | Williams | 244/3.15 |
| 2007/0021880 | A1 * | 1/2007 | Appleby et al. | 701/23 |

* cited by examiner

*Primary Examiner* — Michael Carone
*Assistant Examiner* — Reginald Tillman, Jr.
(74) *Attorney, Agent, or Firm* — Robert K. Tendler; Daniel J. Long

(57) ABSTRACT

A method and apparatus is provided for increasing the effectiveness of destroying selected objects in a target cloud by prioritizing the objects detected in a large aperture IR detector aboard a carrier vehicle and sequentially illuminating the detected targets with coded laser radiation, followed by the launching of multiple miniature kill vehicles from the carrier vehicle, with each kill vehicle assigned to a differently-coded object in the target cloud due to the reflection back of the coded returns, thus to permit directing of individual miniature kill vehicles to a specific object in the target cloud prior to a handoff to an IR heat seeker in the miniature kill vehicle, actuated to guide the kill vehicle for a final kill.

25 Claims, 6 Drawing Sheets

METHOD AND APPARATUS FOR EFFICIENTLY TARGETING MULTIPLE RE-ENTRY VEHICLES WITH MULTIPLE KILL VEHICLES

RELATED APPLICATIONS

This Application claims rights under 35 USC §119(e) from U.S. application Ser. No. 60/604,314 filed Aug. 25, 2004, the contents of which are incorporated herein by reference. This application is related to the following U.S. patent applications, the contents of which are incorporated herein by reference: Ser. No. 09/907,148 filed Jul. 17, 2001; Ser. No. 10/327,610 filed Dec. 20, 2002, now U.S. Pat. No. 6,909,267; Ser. No. 10/334,826 filed Dec. 31, 2002, now U.S. Pat. No. 6,864,965; Ser. No. 10/334,884 filed Dec. 31, 2002, now U.S. Pat. No. 6,877,691; Ser. No. 10/335,088 filed Dec. 31, 2002, now U.S. Pat. No. 6,870,358; Ser. No. 10/400,261 filed Mar. 28, 2003; Ser. No. 10/627,186 filed Jul. 25, 2003; and Ser. No. 10/627,961 dated Jul. 25, 2003.

FIELD OF THE INVENTION

This invention relates to ordnance and more particularly to the guidance of multiple kill vehicles towards targets within a target cloud that include one or more re-entry vehicles and penetration aids in the form of decoys, clutter, chaff, balloons and the like.

BACKGROUND OF THE INVENTION

In a missile attack, a single missile, multiple missiles or a missile with multiple warheads may be launched against a variety of targets, with the missile coming in from space such that, in order to reach its targets, it or its re-entry vehicle or vehicles must re-enter the atmosphere with sufficient protection to prevent disintegration.

In order to countermeasure such incoming missiles and their warheads, it has been proposed to send up a kill vehicle that is designed to directly impact a re-entry vehicle to disable it, either by a direct hit or by altering its trajectory. While in the past projected solutions have included the use of nuclear weapons in space, the obvious disadvantage is the production of radiation. Moreover, rejected solutions include providing conventional explosives aboard a kill vehicle, with proximity fuses to detonate in the vicinity of a re-entry vehicle. The reason that this approach has been rejected is that insufficient energy is available to assure the destruction of the re-entry vehicle and the precise timing required to be effective given the large closing velocity.

As currently deployed to counteract incoming intercontinental ballistic missiles, a single kill vehicle is used to counteract a single re-entry vehicle. However, this type of ICBM countermeasure is ineffectual when decoys or multiple warheads are involved.

More importantly, in order to be able to locate and guide a kill vehicle towards a re-entry vehicle, in the past only infrared sensors have been used to track the re-entry vehicle. In so doing, a carrier vehicle picks up a number of objects in a target cloud, tracks them in the IR and tries to determine the point in space where the objects exist. Upon such determination, the carrier vehicle launches multiple miniature kill vehicles, each with there own IR sensor, to intercept the objects.

The problem with a total infrared solution is first and foremost that the objects themselves are only detectable from 10 to 30 kilometers away for small aperture, low cost IR sensors.

This being the case, in order to effectively launch a counterattack on incoming missiles, one must expend large amounts of fuel for midcourse corrections to maneuver the miniature kill vehicles launched from the carrier vehicle. Because of the relatively short range of the IR detectors, these midcourse corrections can only be made when the kill vehicle is relatively close to its intended target. Late-in-the-game midcourse corrections require the expenditure of a considerable amount of fuel for the thrusters on the miniature kill vehicles that in turn limits payload size or the number of kill vehicles carried by the carrier vehicle.

Moreover, utilizing a total IR system, it is virtually impossible to hand off a very complex series of objects to a set of interceptors and to know that one has a one-to-one correlation. This means that it is difficult to hand off one particular object to one particular interceptor or kill vehicle. The inability to provide a one-to-one correlation between kill vehicles and objects means that a unacceptable number of kill vehicles will miss a particular object because they are directed to the wrong target.

Presently there are means for distinguishing between re-entry vehicles and decoys so that the probability of a kill vehicle intercepting a re-entry vehicle can be maximized. Thus it is possible to categorize the type of objects in a target cloud and to provide an estimate of the likelihood that a particular object is an armed re-entry vehicle.

It will be seen that if a target cloud includes as many as 50 objects, one may not have 50 kill vehicles aboard a carrier vehicle. One therefore has to avoid intercepting decoys or those objects having a low probability of being an armed re-entry vehicle.

Moreover, if a carrier vehicle carries 30 miniature kill vehicles, it may be necessary to deploy multiple carrier vehicles, each with 30 interceptors or kill vehicles, towards a target cloud.

The problem with multiple targets is that one usually wants to assign one kill vehicle to a target. One also wants to avoid targeting decoys. Further, one usually wants to avoid assigning multiple kill vehicles to a single target because it means that other legitimate re-entry vehicles will not be destroyed. Of course, for high-valued targets in a target cloud, there is also the problem of directing multiple kill vehicles to the very high-valued target.

As will be appreciated, not all of the objects in the target cloud are armed re-entry vehicles, with a large number of objects being decoys. The kill vehicle strategy is then to strip out all the decoys so that the next kill vehicle destroys an armed re-entry vehicle. Moreover, if one can identify an armed re-entry vehicle, then one is likely to want to target more than one kill vehicle against the identified re-entry vehicle in order to assure a successful kill.

The important consideration is to be able to effectively assign and direct kill vehicles to particular targets. Currently available discrimination software and algorithms can determine or prioritize objects in the target cloud, but the discrimination is never perfect. Thus one can never determine to a substantial likelihood that the object is an armed re-entry vehicle as opposed to a decoy. Thus, how to get the kill vehicle aimed at the right target is the essential challenge.

SUMMARY OF INVENTION

Rather than employing an all-IR system for determining the position of objects within a target cloud that includes both armed re-entry vehicles and penetration aids such as decoys and chaff, the subject system promotes initially accurate ballistic aiming by providing a laser target designator aboard the carrier vehicle to sequentially sweep the objects of the target cloud and label them. This occurs at a substantial distance from the point at which the kill vehicle guidance system is handed off to its IR heat seeker. Thus a scanning laser target designator is employed in the carrier vehicle that initially detects the location of targets from a large aperture infrared detector and points a laser beam at the detected targets. Thereafter each of the detected targets is sequentially painted with an identifying pulse code, such that light reflected from a target arrives back at the kill vehicle with a code designating the corresponding object in the target cloud.

The range at which such laser target designation is effective is hundreds of kilometers as opposed to tens of kilometers, such that when a kill vehicle is launched, it is directed towards a particular target identified by pulse-coded returns. The trajectory of the kill vehicle to an unambiguously designated target is ballistic, requiring little if any thruster assistance or mid-course correction between the time the kill vehicle is launched and the time it arrives at a point at which the IR heat seeker handoff occurs. This means that the amount of thruster fuel is minimized because the amount of correction is minimized, since only small corrections are required close in. It is appreciated that three-dimensional predicted intercept is the most energy (fuel) efficient method of guidance.

Thus ballistic guidance is employed until the kill vehicle gets close enough to obtain an IR signature due to the higher brightness closer in to the object. In this system each of the identified objects in a target cloud is illuminated in sequence with a high power laser beam. The resulting returns are strong and visible at the miniature kill vehicle early in the process.

Because the laser returns are coded for the particular object, there is a one-to-one correlation between an object that one wants to hit with an individual kill vehicle. This also gives the opportunity to prioritize and optimally disperse the kill vehicles off the carrier vehicle so that the kill vehicles are spaced apart in a way that matches the objects in the cloud. Thus by identifying the objects detected at the large infrared detector on the carrier vehicle and sequentially illuminating each with a predetermined code at long range, one can individually target an object with a predetermined kill vehicle in a one-to-one correlation, thus eliminating target ambiguity.

Note that in one embodiment the laser target designator operates in the one-micron region and typically uses 1.06-micron YAG lasers. The detectors utilized to detect the returns are in general avalanche photodiode detectors operating in the one-micron band.

In one embodiment, each miniature kill vehicle is provided with a central IR detector surrounded by distributed aperture one-micron detectors, in which fiber optics surrounding the IR detector are used to collect the laser returns.

It is noted that, as is usual in heat seekers, long-wave IR in the 8- to 12-micron range is utilized to pick up the relatively cold bodies that operate roughly at room temperature, with room-temperature objects peaking at about 10 microns in terms of the radiation they emit.

In operation, each of the individual pre-targeted miniature kill vehicles is looking for a particular code and thus the target that is illuminated by this code. Initially the miniature kill vehicle is sent to a point in space where the detected object is thought to be. The kill vehicle then follows a ballistic path to this object. Note that the system employs distributed aperture semi-active laser detectors, DASALs, which have enough field of view to assure that a coded object is within its field of view. The size and number of apertures that are distributed determine the detection range. Not only are these detectors able to detect the object but because of the segmented detector there is angular information available to aid in the pointing of the miniature kill vehicle towards its intended target.

When the miniature kill vehicle closes in on the target cloud and its intended target, its IR seeker needs to correlate the particular target available in its IR seeker with the one that it is aimed at based on the laser returns. The way that the infrared seeker knows that the target is the correct target is that the IR target lies along the same angular vector (line of sight) as that associated with the laser returns.

At the point that the correlation is made, the system hands off to the IR guidance system, at which point laser target designation is no longer relied on for the final kill.

What this means is that, close in after the handoff, it can be ascertained that there is a solid track with a 100% correlation between the object in the IR seeker and the intended object to be destroyed. After this has occurred the system resources can be directed to other targets.

Thus, as part of the subject invention, in one embodiment there is two-way communication between the kill vehicles and the carrier vehicle. When, for instance, a heat seeker is locked onto a solid track to its intended target, the carrier vehicle is alerted so it can reduce the time spent in designating this particular target and can redirect kill vehicles to other targets. In this way the subject system enables careful managing of the limited resources available. Because of payload restrictions, it is very important to frugally match the resources to the targets that need to be destroyed, such that after there is a solid track, resources can be directed to other objects in the target cloud.

In terms of the range at which the handoff can take place, for uncooled IR sensors, the advantage is that they are very inexpensive, even though their range is only a few tens of kilometers. For the more expensive cooled indium antimonide or mercury cadmium telluride detectors used in high performance IR sensors cooled by liquid nitrogen, the heat seeker range may in the 50- to 100-kilometer range. However, the cost of these high performance infrared devices militates towards using uncooled detectors in the 10- to 20-kilometer range. This means that it is more and more important to be able to ballistically guide the miniature kill vehicles towards their particular targets at a very early stage in their deployment. What makes this possible is the use of the laser target-designating system because the high-intensity returns from the target cloud are viewable from hundreds of kilometers.

The advantage to the subject system is that one is not missing targets in the target cloud and not overkilling a target. In short, one is not sending more kill vehicles to kill a particular target in the cloud or less than one wants to.

This also gives rise to the ability to multiply target a very high-value object when one is relatively certain that it is an armed re-entry vehicle. This is done by diverting some of the kill vehicle resources to multiply impact this high-valued target. In order to accomplish this, in one embodiment the laser target designator designates this high-value target with multiple codes such that multiple kill vehicles are programmed to impact this high-valued target.

For instance, if one can ascertain that there is a high-valued target in the target cloud, one can sequence through, for instance, three or four codes so that three or four kill vehicles can be programmed to impact this high-valued target. Alternatively a number of kill vehicles can be given the same code, thereby increasing the laser designator update rate.

However, the timing and separation of multiple miniature kill vehicles impacting a single high-valued target is important because one does not want the kill vehicles to collide with each other.

One could, of course, time the impacts of the kill vehicles to be different, so one can purposely space the kill vehicles out in time. However; if one kill vehicle impacts the target ahead of a second kill vehicle, then its partial impact may so disturb the scene that the subsequent kill vehicles will be diverted off course, due to the debris caused by the first kill vehicle.

An alternative way of targeting a high-valued target with multiple miniature kill vehicles is to separate them out and vector them in so that they come in at the high-valued target at different angles. When they come in at different angles, the scenario requires that they hit the high-valued target at the same time so as not to perturb the target ahead of time and cause subsequent kill vehicles to miss the target or fail to do maximal damage.

By virtue of the fact of illuminating the high-valued target with multiple codes, one can separately guide each of the individual kill vehicles assigned to this target via mid-course corrections to come in at the high-valued target from different angles.

Additionally and as part of the subject invention, one can provide retro-reflectors on each of the miniature kill vehicles so that the kill vehicles themselves, upon being illuminated with the laser target designator from the carrier vehicle, can provide their position in space back to the carrier vehicle. The carrier vehicle will then have enough real time information to calculate midcourse corrections to fly each of the selected kill vehicles towards the high-valued target but at different intercept vectors. This being the case, since the individual kill vehicles have a predetermined pulse code to which they respond, and since they are illuminated by a laser target designator having the particular code, the carrier vehicle can track each of the individual kill vehicles in space and provide guidance commands to the kill vehicles on the fly for midcourse corrections. One application provides the retro-reflectors on kill vehicles so that midcourse corrections can initiate a multiple kill vehicle attack.

Moreover, it may be that the value of the target is not known at the time of the deployment of the kill vehicles. However, because the position in space of the kill vehicles is known due to the laser target designation and retro-reflectors, the same process by which objects in the target cloud are identified can also be used for on-the-fly midcourse corrections to target later-identified objects in the target cloud.

Also, if a kill vehicle is determined by the retro-reflections to be off course, corrective measures can be taken to put it back on course, thus to maximize the effectiveness of all of the kill vehicles for providing more reliable re-entry vehicle kills.

In summary, a method and apparatus is provided for increasing the effectiveness of destroying selected objects in a target cloud by prioritizing the objects detected in a large aperture IR detector aboard a carrier vehicle and sequentially illuminating the detected targets with coded laser radiation, followed by the launching of multiple miniature kill vehicles from the carrier vehicle, with each kill vehicle assigned to a differently-coded object in the target cloud due to the reflection back of the coded returns, thus to permit directing of individual miniature kill vehicles to specific objects in the target cloud prior to IR heat seeker handoff for the final kill.

BRIEF DESCRIPTION OF THE DRAWINGS

These and other features of the subject invention will be better understood in connection with a Detailed Description, in conjunction with the Drawings, of which:

FIG. 3 is a diagrammatic illustration of the distributed aperture acquisition of a target that has been illuminated by a coded pulse from a laser on the carrier vehicle at a considerably longer distance than the terminal phase at which the heat seeker in the miniature kill vehicle is actuated or handed off to;

DETAILED DESCRIPTION

Before describing the figures, it will be appreciated that, when faced with as many as 50 objects in a target cloud, there is a question as to how many traditional heat-seeking kill vehicles can reliably kill an armed re-entry vehicle. If the number of objects in a cloud is relatively few, then traditional heat seekers can effectively guide the corresponding kill vehicle to impact the object. However, as the number of objects increases, there is an exponential decay in performance, resulting in a substantial amount of miscuing.

Note that the penetration aids utilized by intercontinental ballistic missiles are used to purposely confuse the defenses targeting them, which gives rise to the need for multiple interceptors. Current deployments of exo-atmospheric kill systems employ only one interceptor, which gives rise to the necessity of developing a reliable and effective multiple kill vehicle system.

As will be appreciated, IR heat seekers can start picking up targets, but instead of seeing one object, the infrared detector detects multiple objects. Rather than picking one of the objects, it has been the practice to simply track the centroid of the objects. However, by tracking the centroid using a simple centroiding algorithm, the kill vehicle flies right through the middle of the objects, missing them all.

Aside from being able to distinguish which objects are real targets and which are decoys, assuming that one could discriminate between the two, there is a substantial problem in providing midcourse corrections for the miniature kill vehicles in terms of the amount of fuel that must be carried by each miniature kill vehicle and thus the total payload weight for the carrier vehicle.

The subject invention provides an initial ballistic trajectory for each kill vehicle from the launch point on the carrier vehicle, which ballistic trajectory is altered only close in to the target cloud to conserve fuel. When close in, the system aboard the kill vehicle hands off to a conventional infrared heat seeker. The result is that the amount of required thruster fuel can be dramatically decreased, since the individual miniature kill vehicle is on a collision course with the right target cloud object.

Figure 1:
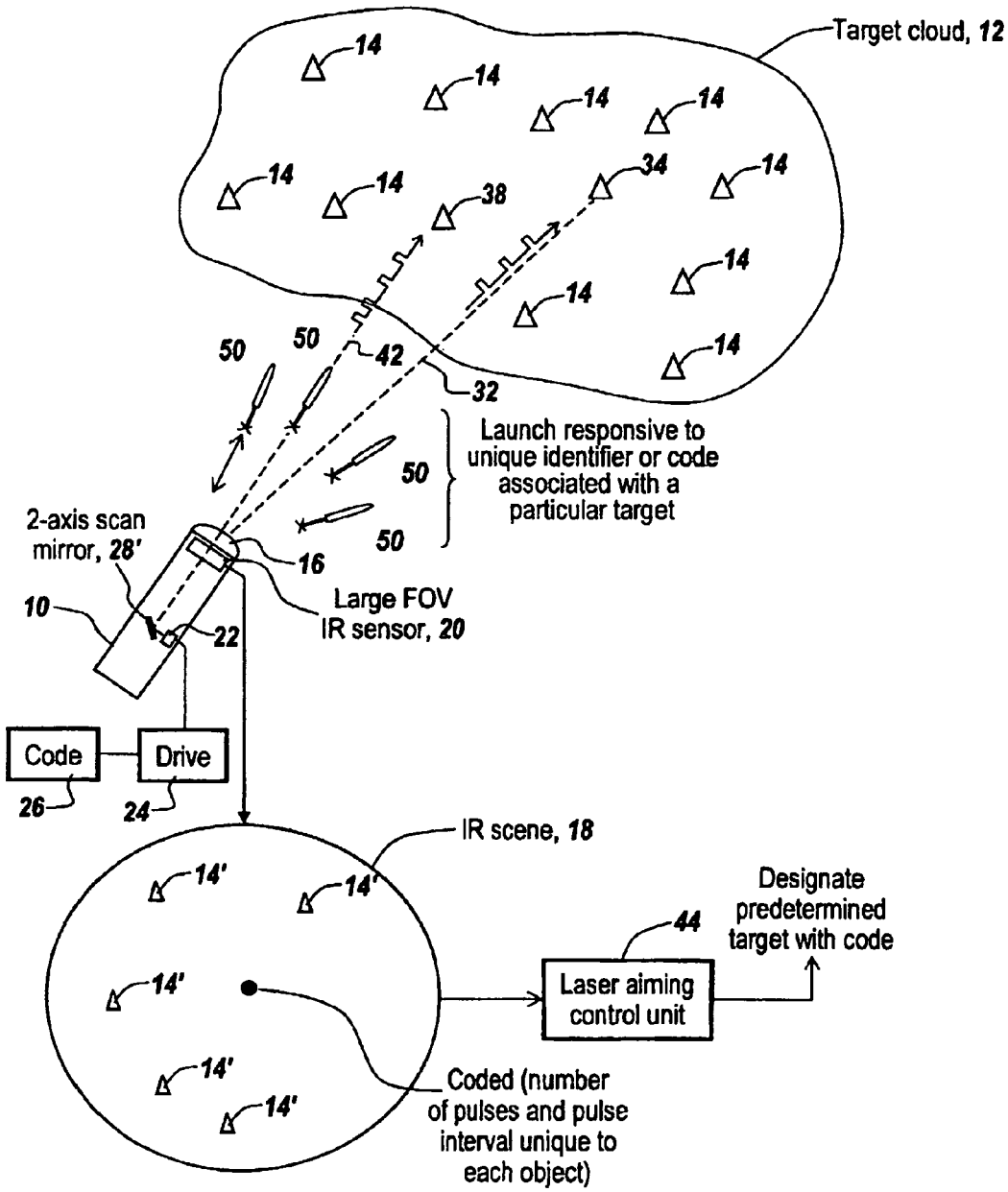
FIG. 1 is a diagrammatic illustration of the coded laser target designation of objects in a threat cloud from objects detected through a large-aperture IR detector on board a carrier vehicle, which launches multiple miniature kill vehicles, each assigned to a differently-coded object in the target cloud by virtue of the reflection back of the coded laser illumination, thus to permit directing of each of the individual miniature kill vehicles to a specific object in the target cloud prior to the time that the heat seeker in each of the miniature kill vehicles is actuated for a final kill.

In order to provide an improved multiple kill vehicle system and referring now to FIG. 1, upon detection of an incoming missile, a carrier vehicle 10 is launched in the direction of a target cloud 12, which has within the target cloud a number of objects 14, some of which are armed re-entry vehicles and some of which are decoys to confuse the defensive system.

Each of the objects 14 are detected by a large-field-of-view IR imaging system 16 aboard carrier vehicle 10 to produce an IR scene 18 in which corresponding objects 14' are located in the scene as illustrated. Because of their detected location, the direction to each of these objects can be ascertained. Scene 18 is developed by IR sensor 20 so that a large portion of the sky may be scanned at the carrier vehicle.

Carrier vehicle 10 is provided with a high-powered laser target designator that includes laser 22 actuated by a drive 24, the laser to output a predetermined code 26 either in terms of the number of pulses or the pulse spacing of the pulses generated by the laser. This results in the projection of coded laser pulses towards various of the objects within the target cloud. In order to select an object in the target cloud the beam from laser 22 is scanned using a two-axis scan mirror 28 such that individual objects in the target cloud are painted in a sequential fashion with a unique pulse code. The result is the painting of each different object with a different pulse code such that energy returned from the illumination of the object has the same pulse code. Here, as illustrated, pulses 30 are projected along a line 32 towards a particular object 34. The coded pulses that illuminate object 34 are returned over a large reflectance angle, namely angles 32, so that the direction to a particular illuminated object can be ascertained by detecting the coded laser returns. In the illustrated embodiment, object 34 is designated by the pulse code 30, whereas at a subsequent scan position, object 38 is illuminated by pulses having a different pulse code 40, all along line 42.

Two-axis scan mirror 28 is controlled by a laser aiming control unit 44, which takes the positions of the objects as determined by IR scene 18 and assigns a predetermined pulse code to a predetermined object.

Upon illumination of selected objects in target cloud 12, a plurality of kill vehicles 50 are launched from carrier vehicle 10 along the direction of the assigned object in the target cloud.

In one embodiment the kill vehicles have a distributed aperture laser return detection system that not only is used to detect the pulse-coded returns from the painted target but also is used to determine the bearing toward the target so that thrusters can be fired to redirect the kill vehicle to the intended target. What is accomplished is that each of the individual kill vehicles can be initially directed towards a particular target and be made to follow a ballistic trajectory towards the target until such time as the IR heat seeker on the kill vehicle detects the target when it is in range.

Figure 2:
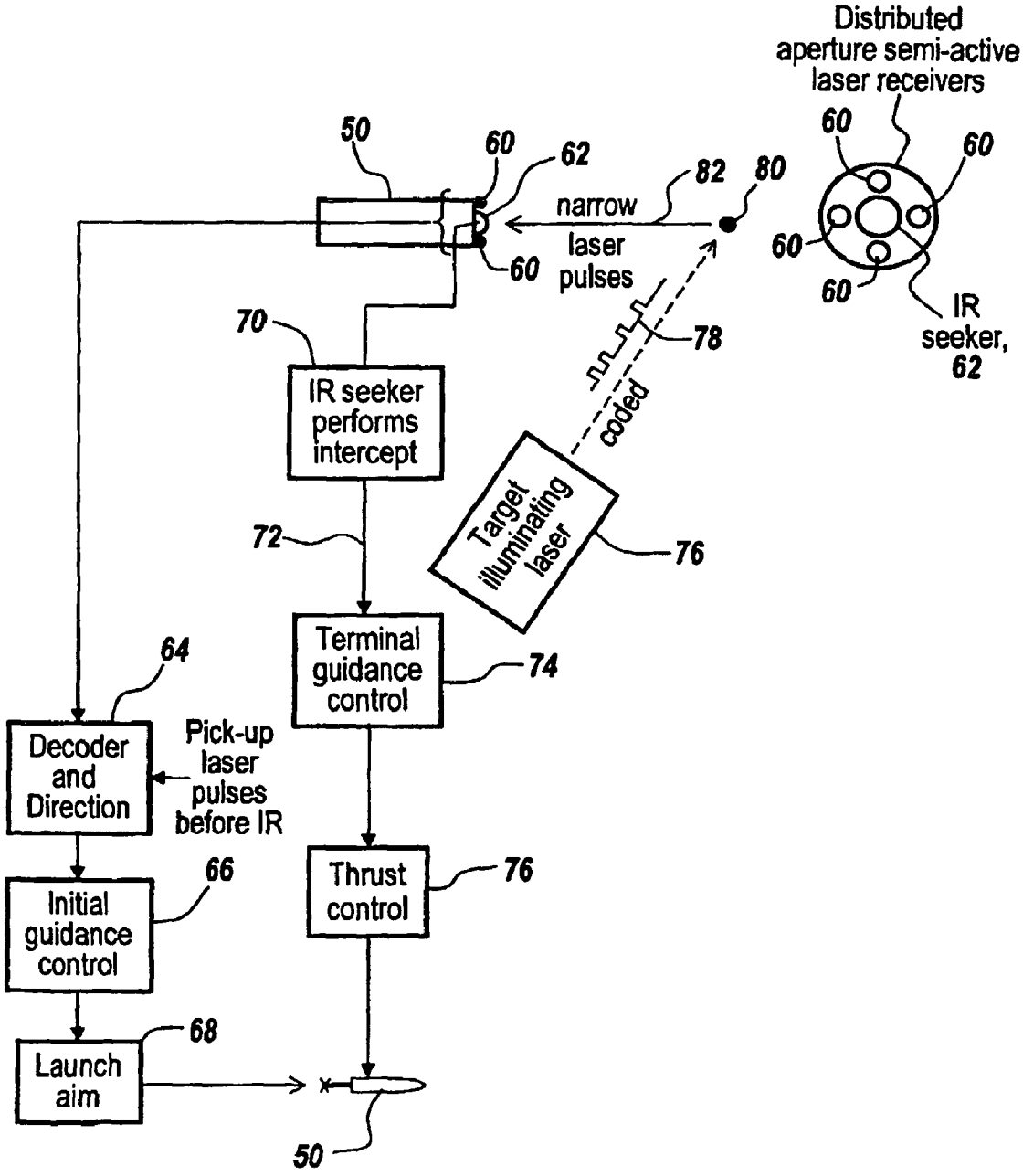
FIG. 2 is a diagrammatic illustration of the system aboard each of the miniature kill vehicles of FIG. 1, including decoding of a particular code and ascertaining the direction of the object reflecting the particular coded laser pulses to effectuate initial aiming after launch of the kill vehicle, followed by terminal guidance control with an IR sensor when the kill vehicle is sufficiently close to its intended target within the target cloud.

Referring now to FIG. 2, each of kill vehicles 50 is provided with a distributed aperture detection system 60 including fiber optic input apertures that surround the wide-angle IR imaging system 62 carried by the kill vehicle. The outputs of the distributed detectors for the laser band involved, namely the one-micron band, are decoded at 64 and the direction to the painted target is ascertained at this unit. Note that the distributed aperture detection system picks up the returned pulses much before the infrared radiation from the object is detectable by the IR detector.

The output of the decoder 64 is coupled to an initial guidance control module 66, which initially aims miniature kill vehicle 50 as illustrated at 68 along a ballistic path to the target.

When the kill vehicle is within, for instance, 10 kilometers of its intended target, an IR seeker 70 is activated to perform its intercept function and outputs signals over line 72 to terminal guidance control module 74 that controls thrusters 76 to provide a course correction for the miniature kill vehicle so as to assure direct impact and a kill.

As illustrated, the target-illuminating laser here depicted at 76 provides a pulse-coded series of pulses 78 towards a particular target 80, with the reflected pulses that paint target 80 being relatively narrow laser pulses. It is these pulses that are reflected back over line 82 towards kill vehicle 50.

Figure 3:
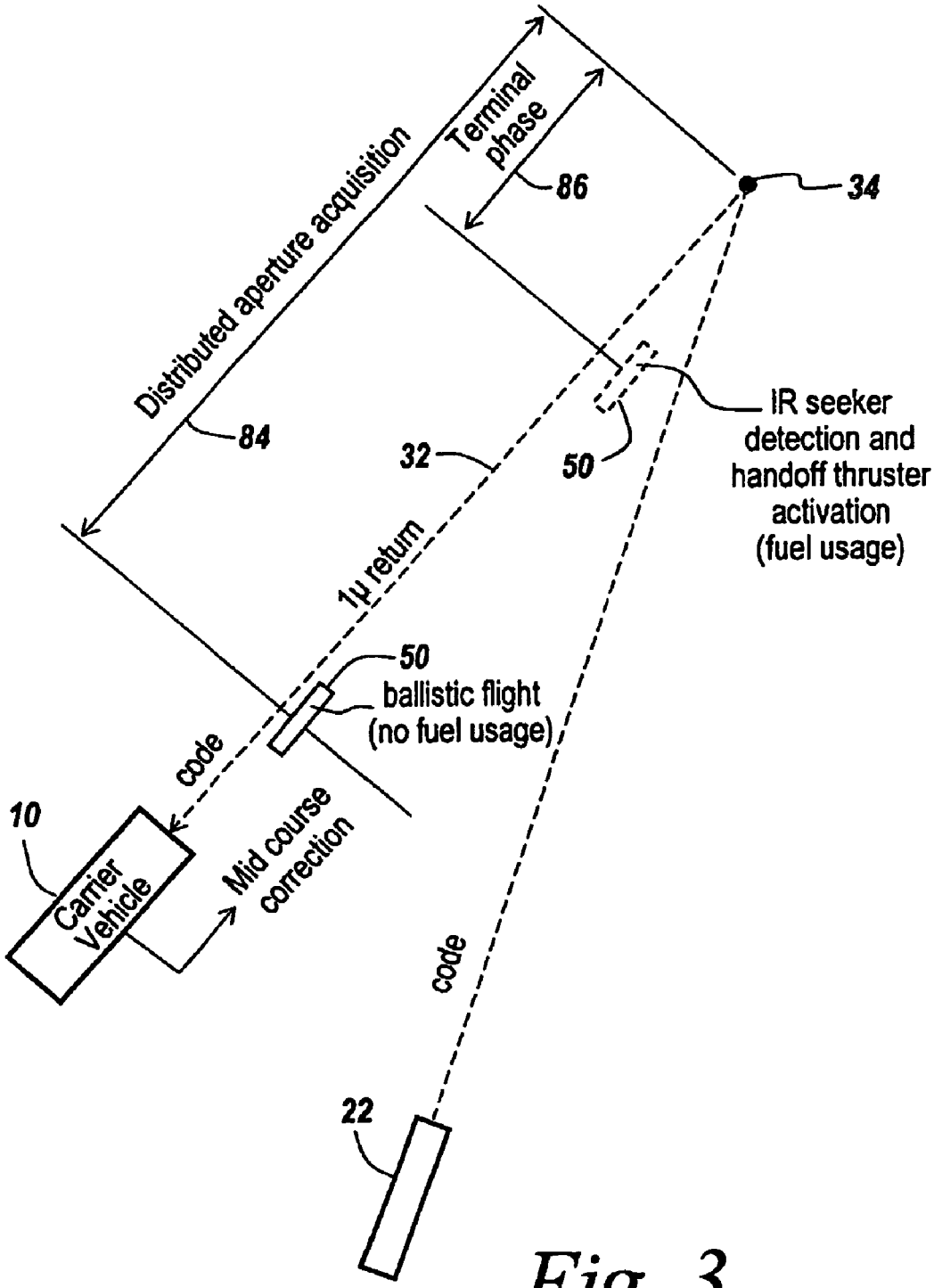

Referring now to FIG. 3, to illustrate the fuel savings with the subject system, it will be appreciated that carrier vehicle 10 launches a kill vehicle 50 towards a predetermined target 34 along a direction 32. At the point that the miniature kill vehicle guidance system takes over after launch, the distributed aperture acquisition system aboard kill vehicle 50 picks up the high intensity one-micron reflected laser pulses at a distance of between 100 and 300 kilometers as illustrated by arrow 84. It will be appreciated that, from the time that kill vehicle 50 is directed along line 32 to target 34. Ballistic flight ensues until such time as kill vehicle 50 enters into IR seeker acquisition range as illustrated by dotted outline 50'. This corresponds to the terminal phase of the flight of the kill vehicle as illustrated by arrow 86, at which time thrusters aboard kill vehicle 50 are activated to reposition or re-direct the kill vehicle towards object 34 using conventional IR seeker technology. It is at this point, namely 10 to 15 kilometers from the intended target, that thruster activation is used.

It is noted that by providing initial ballistic flight towards a target that has been identified through painting of the target with a laser target designator code, one need not provide large amounts of fuel to provide mid-course corrections for the kill vehicle. All that is necessary when handing off to the IR seeker are small thruster bursts that use only small amounts of energy. Thus in the terminal phase only a small amount of fuel is necessary to realign the kill vehicle with its intended target.

Figure 4:
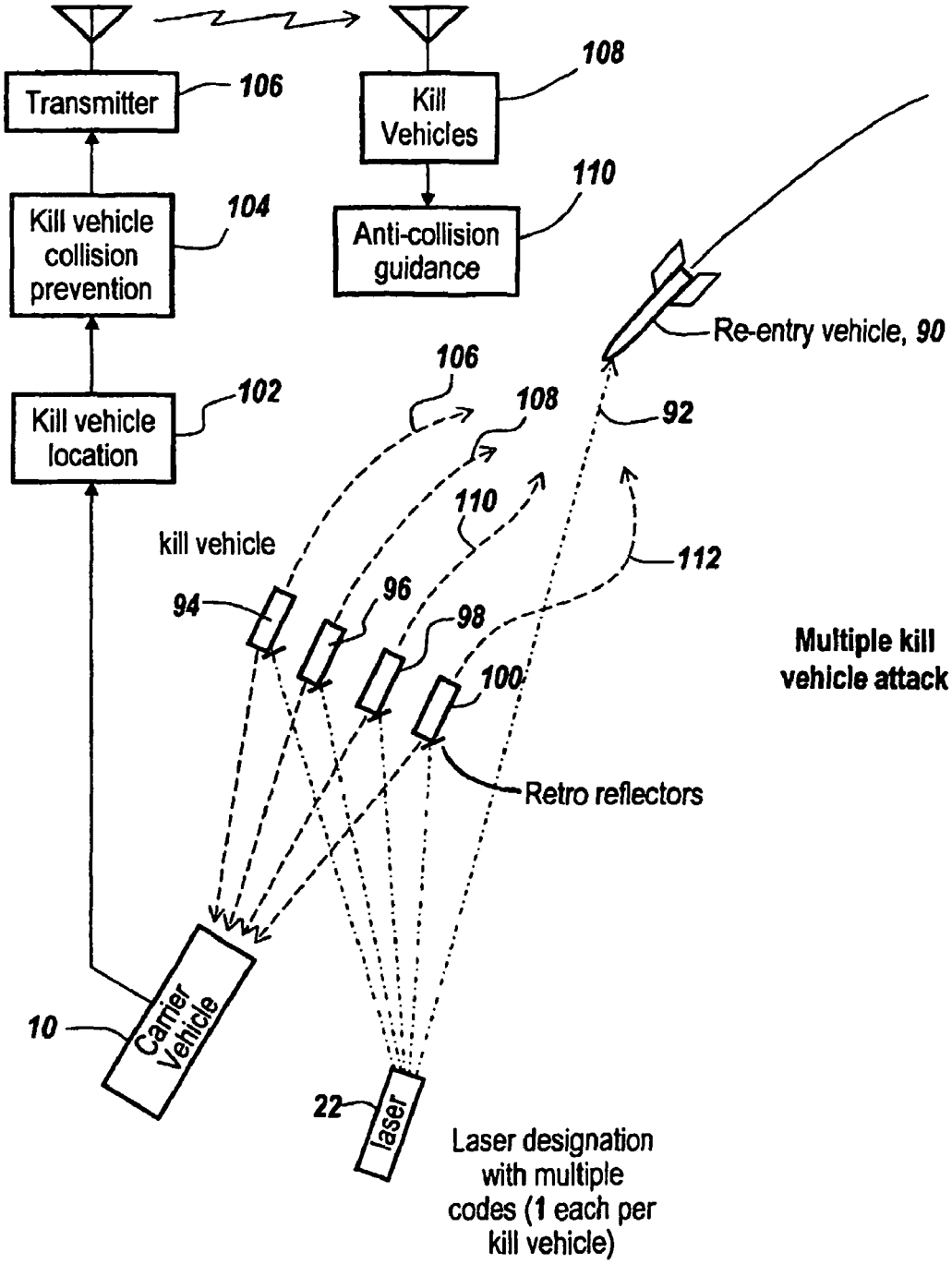
FIG. 4 is a diagrammatic illustration of the use of a multiple kill vehicle attack on a high-valued re-entry vehicle to provide anti-collision guidance for the multiple kill vehicles so that they can near simultaneously impact the re-entry vehicle from different vectors.

Referring now to FIG. 4, assuming that a re-entry vehicle 90 has been determined as a high-priority, warhead-carrying, armed re-entry vehicle, then it is useful to be able to target the vehicle with multiple miniature kill vehicles. In this embodiment, laser 22 paints the high-value target 90 with a number of different pulse codes along line 92. What this accomplishes is assigning a number of different kill vehicles to intercept the high-value target to ensure a kill.

In order to prevent collision of the kill vehicles, here illustrated at 94, 96, 98 and 100, the location of these kill vehicles is ascertained by illuminating the kill vehicles with the self-same code used to assign the kill vehicle to the high-value target. Each of the kill vehicles 94-100 is provided with retro-reflectors that return the incident radiation back to carrier vehicle 10, where the direction and therefore position of each of the kill vehicles is ascertained. This is accomplished by a module 102, which ascertains from the retro-reflected energy the direction of each individual kill vehicle.

In order to prevent collision, a module 104 ascertains how far off the original trajectory each kill vehicle is to be moved so that they can be vectored towards high-value target 90 from different directions as illustrated at 106, 108, 110 and 112 without the possibility of collision.

Kill vehicle collision prevention module 104 communicates to the kill vehicles via a transmitter 106 the required mid-course corrections, here illustrated at 108. This action results in mid-course corrections through the use of an anti-collision guidance module 110.

The result is that, while all of the kill vehicles assigned to the high-value target are initially launched along direction 92 towards the high-value target, at some point during the flight of each of these kill vehicles, they are directed off of line 92 to separate them. Thereafter they are re-aimed at the high-value target so as to vector in on the high-value target from different directions. It is a purpose of this scenario to impact the high-value target with multiple kill vehicles at the same instant in time so as to assure the destruction of the high-value target.

Since the kill vehicles are provided with retro-reflectors, it is possible to know during their flight exactly where each individual kill vehicle is and to be able to reposition it prior to impacting the high-value target.

It is noted that since the kill vehicles are provided with retro-reflectors, once a handoff has been made to the kill vehicle's IR seeker, this handoff occurrence can be transmitted back to carrier vehicle 10 so that other kill vehicles can be maneuvered to target other objects in the target cloud. The retro-reflectors aboard each miniature kill vehicle permit ascertaining where the kill vehicle is at the point of hand-off so that midcourse guidance can be activated for other kill vehicles so they can target different objects in the target cloud, since they are no longer needed to destroy the originally-targeted high-value target.

Figure 5:
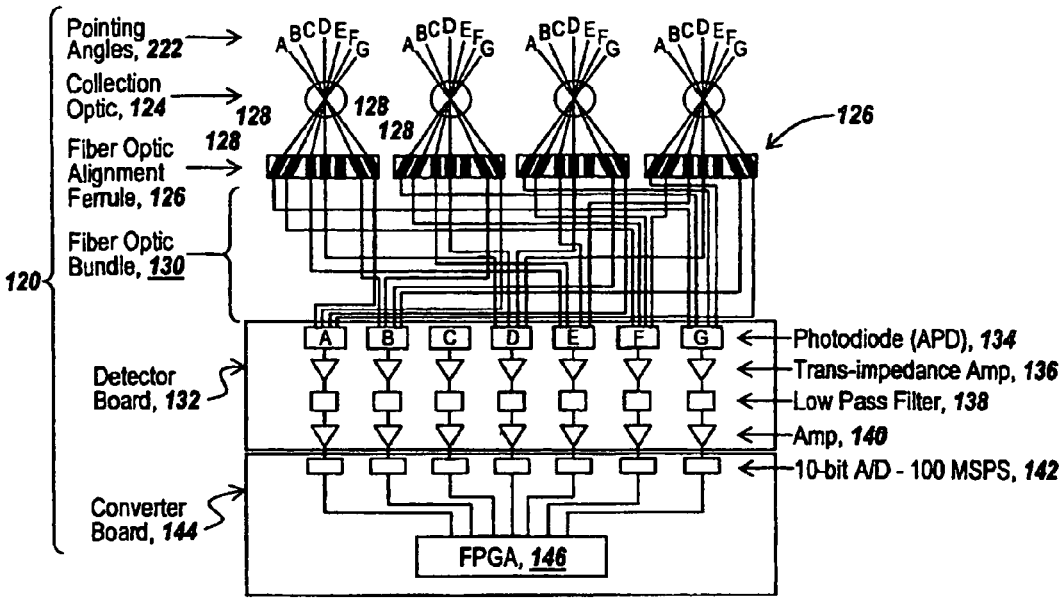
FIG. 5 is a diagrammatic illustration of the distributed aperture laser return detecting system that is able to detect not only the presence of returns from an object in the target cloud, but also its angular position relative to the associated kill vehicle boresight.

Referring now to FIG. 5, what is described is the distributed aperture laser return detection system, here shown by reference character 120. In order for the various distributed apertures to detect different pointing angles 122, the distributed aperture laser return detection system incorporates collection optics 124 that images far-field objects onto a fiber optic alignment ferrule 126 that has individual fiber optic sections 128 oriented in different directions so as to detect light from objects at the various pointing angles, A, B, C, D, E, F and G.

These fiber optic sections are coupled via a fiber optic bundle 130 to a detector board 132, which incorporates photodiodes 134, transimpedance amplifiers 136, low-pass filters 138, amplifiers 140 and 10-bit analog-to-digital converters 142 in a converter board 144 that also includes a field programmable gate array 146 coupled to respective analog-to-digital converters.

As shown, photodiodes 134 are coupled to fiber optic alignment ferrule sections 128 such that each one of the photodiodes is provided with signals corresponding to a predetermined pointing angle.

It is the use of this type of distributed aperture angle-sensitive system that provides each of the kill vehicles with angular information as to the location of the object in the target cloud to which it is assigned. This means that both initial ballistic trajectory and midcourse corrections can be made based on the angle of the intended target relative to the boresight of the kill vehicle as detected by the distributed aperture laser return detection system.

Thus in one embodiment, each aperture is segmented into seven look angles and is correspondingly summed into a detector. The output for each detector is amplified, filtered and digitized before signal processing to extract the source angle relative to boresight. Note that the apertures are located around a central larger aperture for the IR seeker sensor.

Figure 6:
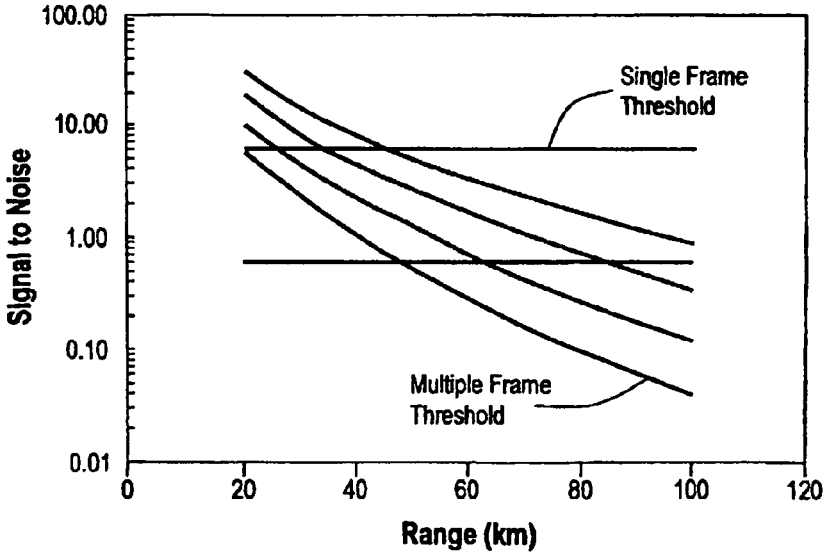
FIG. 6 is a graph of range versus signal-to-noise ratio indicating that for distributed apertures, multiple frame signal processing extends ranges over those associated with single frame thresholds; and, FIG. 7 is a diagrammatic illustration of a common aperture approach for detecting laser returns and IR energy through the utilization of a Cassegrain telescope.

Referring to FIG. 6, what is shown is a graph of range versus signal-to-noise ratio for various target areas relative to single frame and multiple frame thresholds.

The performance described is for two target areas, namely 0.5 and 1.5 $m^2$ areas. The optics consist of 6 15-mm ball lenses coupled to optical fibers around a 5-cm IR aperture. As can be seen from the graph of FIG. 6, the detection range is dependent on the level of signal processing applied.

For simple single-frame processing, the range performance is not adequate. By applying the multi-frame methods developed to extract IR signatures at low signal-to-noise ratios, the performance can be significantly improved to become viable for the intended application.

Figure 7:
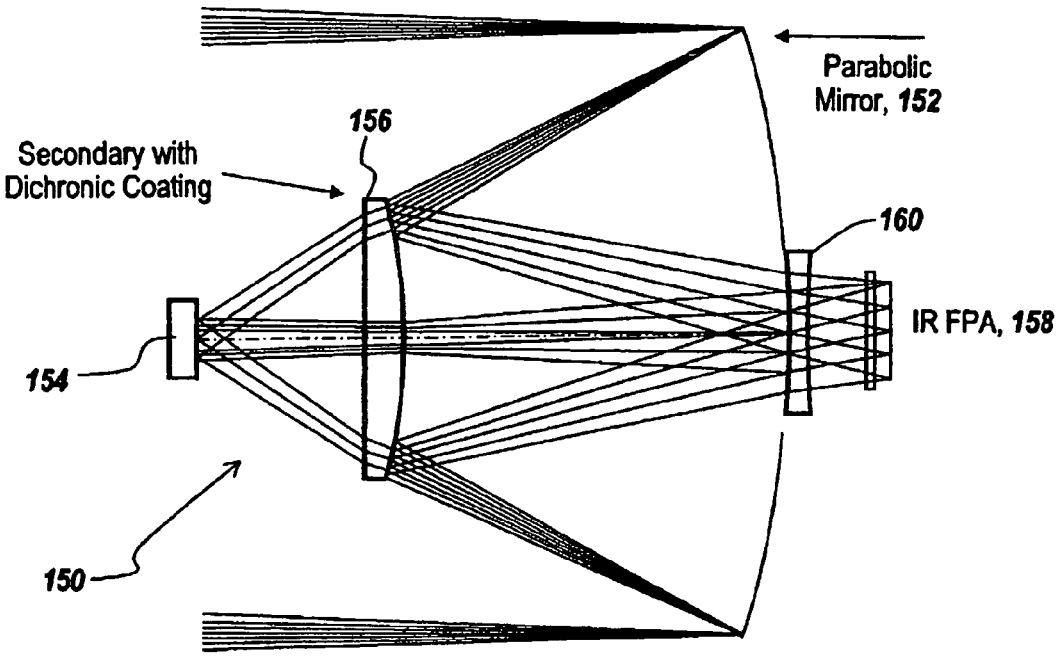

Referring now to FIG. 7, another method for implementing the subject system is based on a common aperture approach. In this embodiment, a Cassegrain telescope 150 includes a parabolic mirror 152 focused onto a laser return focal plane detection array 154 through an optical correction optic 156. This optic passes the laser returns and reflects the IR energy to an IR focal plane array 158 through an optical element 160 that focuses the infrared energy onto the focal plane array.

Note that this embodiment uses a Cassegrain telescope with optical correction in the IR path, with the laser energy from the target passed through dichroic filter correction optic 156 where it is imaged on focal plane array 154.

In this manner, energy from an object in the target cloud is separated by wavelength and focused onto different focal plane arrays.

Whether the distributed aperture detection system or the Cassegrain telescope is used for the collection of energy from objects in the target cloud, it will be appreciated that the long-range angular detection is based on the coded laser returns, whereas the terminal phase IR detection handoff comes from detection of the particular object by the IR detection system.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for increasing the efficiency of destroying selected objects in a target cloud produced by an incoming missile, comprising the steps of:

detecting the presence and location of objects in a target cloud;

illuminating selected objects in the target cloud with coded laser radiation, a selected code being assigned for a selected object;

launching multiple kill vehicles from a carrier vehicle towards the target cloud each along a line-of-sight to a selected object based on returned coded laser radiation, whereby different objects in the cloud can be selectively targeted with at least one dedicated kill vehicle, detecting when a first kill vehicle is on the way to killing a first selected object by providing the first kill vehicle with retro reflectors for ascertaining the position in space of the first kill vehicle;

retargeting said first kill vehicle to a different selected object by altering its original flight path via a midflight correction to a first selected object to another selected object upon confirmation that another kill vehicle is on the way to killing said first selected object.

2. The method of claim 1, wherein the launching step includes initially guiding each launched kill vehicle along a ballistic trajectory towards a selected object.

3. The method of claim 2, wherein the initial guidance is performed using a distributed aperture laser return detector from which angular information is available.

4. The method of claim 3, wherein each kill vehicle is provided with an IR seeker, and further including the step of handing off kill vehicle guidance to the IR seeker when the selected object is in range during terminal guidance, whereby fuel expenditure is minimized and expended primarily in terminal guidance.

5. The method of claim 4, wherein confirmation of the selected object is made by comparing the ballistic trajectory angle with the IR seeker angle, the two angles being the same confirming a successful handoff.

6. The method of claim 1, and further including the step of identifying an object as a high-value target and illuminating the high-value target with differently coded laser radiation, and assigning more than one kill vehicle to the high-value target based on differently coded returns such that each kill vehicle assigned to the high-value target responds to a differently coded return therefrom to guide the kill vehicle to the high-value target, thus to effectuate multiple kill vehicle impacts with the high-value target.

7. The method of claim 6, wherein each of the kill vehicles has an IR seeker to which control is handed off during a terminal guidance phase and wherein each of the kill vehicles is guided by the IR seeker towards the high-value target along a different trajectory to avoid kill vehicle collisions.

8. The method of claim 6, wherein the kill vehicles assigned to the high-value target are guided along different trajectories to impact the high-value target from different directions.

9. The method of claim 8, wherein the kill vehicles nearly simultaneously arrive at the high-value target.

10. The method of claim 1, wherein each of the kill vehicles is provided with a retro-reflector and further including the steps of illuminating a kill vehicle with a coded laser beam detecting retro-reflected coded laser beams from kill vehicles and establishing from the coded returns the identity and precise 3D track position of the kill vehicle in space to enable midcourse corrections for a multiple kill vehicle attack on an object.

11. The method of claim 10, and further including the step of providing targeting commands to a kill vehicle based on its detected 3D track.

12. A method for minimizing fuel payload in a multiple kill vehicle mission in which multiple kill vehicles are launched towards a target cloud, comprising the steps of:

painting selected objects in the target cloud with differently coded laser pulses to identify the selected objects by the laser returns therefrom;

initially guiding the kill vehicles to associated targets using the coded laser returns along a ballistic trajectory in which fuel consumption for midcourse corrections is minimized;

handing off kill vehicle guidance to an IR seeker aboard a kill vehicle when the kill vehicle is within IR seeker range, whereby the fuel expended is expended largely in the terminal guidance phase, thus to minimize kill vehicle fuel payload requirements, and;

retargeting a kill vehicle to a different selected object by altering its original flight path via a midflight correction to a first selected object to another selected object upon confirmation that another kill vehicle is on the way to killing said first selected object.

13. The method of claim 12, wherein the laser pulses are in the 1-micron band and wherein the IR seekers operate in the 8-10 micron band, whereby initial guidance is made possible at much larger distances to an object in the target cloud as compared with IR seeker detection ranges.

14. The method of claim 12, wherein the IR seeker is uncooled and thus of more limited range as compared to a cooled IR seeker, the coded laser pulse tracking being effective at much greater range than that associated with uncooled IR seekers, thus to permit use of uncooled IR seekers.

15. Apparatus for effectuating destruction of objects within a target cloud associated with an incoming missile, comprising:

a carrier vehicle;

a number of kill vehicles aboard said carrier vehicle, each of said kill vehicles including an IR seeker and a distributed aperture laser return detector responsive to preselected coded laser returns;

a laser for sweeping said target cloud and for illuminating selected objects in said target cloud with differently coded pulse trains, and;

a targeting module for retargeting a kill vehicle to a different selected object by altering its original flight path via a midflight correction to a first selected object to another selected object upon confirmation that a kill vehicle is on his way to killing said first selected object.

16. The apparatus of claim 15, and further including an IR detector for detecting the position of objects in said target field and for causing said laser to emit a uniquely coded pulse train when said laser is aimed at the position of an object as determined by said wide-field-of-view IR detector.

17. The apparatus of claim 16, wherein said laser is aboard said carrier vehicle.

18. The apparatus of claim 15, wherein each of said kill vehicles includes a retro-reflector to permit ascertaining the position in space of the associated kill vehicle by retro-reflections therefrom.

19. The apparatus of claim 15, wherein said IR seekers are uncooled.

20. A method for increasing the efficiency of destroying selected objects in a target cloud produced by an incoming missile:

detecting the presence and location of objects in a target cloud;

illuminating selected objects in the target cloud with coded laser radiation, a selected code being assigned for a selected object;

launching multiple kill vehicles from a carrier vehicle towards the target cloud each along a line-of-sight to a selected object based on return coded laser radiation; and, each kill vehicle being provided with an IR seeker and further including the steps of handing off kill vehicle guidance to the IR seeker when the selected target is in range during terminal guidance and retargeting a kill vehicle to a different selected object by altering its original flight path via a midflight correction to a first selected object to another selected object upon confirmation that another kill vehicle is on its way to killing said first selected object.

21. A method for increasing the efficiency of destroying selected objects in a target cloud produced by an incoming missile:

detecting the presence and location of objects in a target cloud;

illuminating selected objects in the target cloud with coded laser radiation, a selected code being assigned for a selected object;

launching multiple kill vehicles from a carrier vehicle towards the target cloud each along a line-of-sight to a selected object based on return coded laser radiation;

identifying an object as a high-value target and illuminating the high-value target with differently coded laser radiation and, retargeting a kill vehicle to a different selected object by altering its original flight path to a first selected object to another selected object via a midflight correction upon confirmation that another kill vehicle is on its way to killing said first selected object.

22. The method of claim 21, and further including the step of assigning more than one kill vehicle to the high-value target based on differently coded returns such that each kill vehicle assigned to the high-value target responds to a differently coded return therefrom to guide the kill vehicle to the high value target, thus to effectuate multiple kill vehicle impacts with the high value target.

23. The method of claim 22, wherein each of the kill vehicles has an IR seeker to which control is handed off during a terminal guidance phase and wherein each of the kill vehicles is guided by the IR seeker towards the high value along a different trajectory to avoid kill vehicle collisions.

24. The method of claim 21, wherein the kill vehicles assigned to the high-value target are guided along different trajectories to impact the high-value target from different directions.

25. The method of claim 24, wherein the kill vehicles nearly simultaneously arrive at the high-value target.

* * * * *